US008123224B2

(12) United States Patent
DeRuyter

(10) Patent No.: US 8,123,224 B2
(45) Date of Patent: Feb. 28, 2012

(54) ELECTRONIC LIGHTED DIE WITH GIMBAL MOUNT

(76) Inventor: Craig DeRuyter, Belgium, WI (US)

( * ) Notice: Subject to any disclaimer, the term of this patent is extended or adjusted under 35 U.S.C. 154(b) by 981 days.

(21) Appl. No.: 12/107,325

(22) Filed: Apr. 22, 2008

(65) Prior Publication Data

US 2008/0265505 A1 Oct. 30, 2008

Related U.S. Application Data

(60) Provisional application No. 60/915,111, filed on Apr. 30, 2007.

(51) Int. Cl.
*A63F 9/04* (2006.01)

(52) U.S. Cl. ..... 273/146; 463/22

(58) Field of Classification Search ..... 463/22; 273/138.1, 132, 146, 144 R, 145 R, 142 A, 273/139, 148 R
See application file for complete search history.

(56) References Cited

U.S. PATENT DOCUMENTS 3,645,532 A * 2/1972 McNaney ..... 273/142 A
(Continued)

FOREIGN PATENT DOCUMENTS

EP 577415 A2 * 1/1994

*Primary Examiner* — Dmitry Suhol
*Assistant Examiner* — Alex F. R. P Rada, II
(74) *Attorney, Agent, or Firm* — Lambrecht Patent Law, LLC

(57) ABSTRACT

A device comprised of: a shell forming a chamber within the shell; an inner housing allowed to freely rotate within the chamber of the shell and a display unit with multiple light sources within the inner housing. The display unit is weighted such that light sources always face upward when the device comes to rest. When dropped, the display unit randomly illuminates at least one of the light sources to indicate a number, simulating the roll of a die.

20 Claims, 3 Drawing Sheets

U.S. PATENT DOCUMENTS 4,124,881 A 11/1978 Haber
4,148,488 A 4/1979 Kohlhagen
4,181,304 A 1/1980 Haber
4,431,189 A 2/1984 Wiencek
4,641,840 A 2/1987 Larson
4,669,728 A 6/1987 Carden
4,858,931 A 8/1989 McKechnie
5,031,914 A 7/1991 Rosenthal
5,184,790 A * 2/1993 Fowell ..... 244/165
5,344,145 A * 9/1994 Chadwick et al. ..... 463/31
5,362,052 A * 11/1994 Kubatsch ..... 273/145 R
6,220,594 B1 4/2001 Peng
6,308,791 B1 * 10/2001 Spletzer et al. ..... 180/8.1
6,331,145 B1 12/2001 Sity
6,394,903 B1 5/2002 Lam
7,017,905 B2 3/2006 Lindsey
7,204,754 B2 * 4/2007 Gray et al. ..... 463/16

* cited by examiner

ELECTRONIC LIGHTED DIE WITH GIMBAL MOUNT

CROSS-REFERENCE TO RELATED APPLICATIONS

This application claims priority, in part, to U.S. Provisional Application No. 60/915,111 filed Apr. 30, 2007.

FIELD OF INVENTION

This invention relates generally to the field of playing dice, and in particular to the field of playing dice having an electronically illuminated display.

BACKGROUND

Figure 1A:
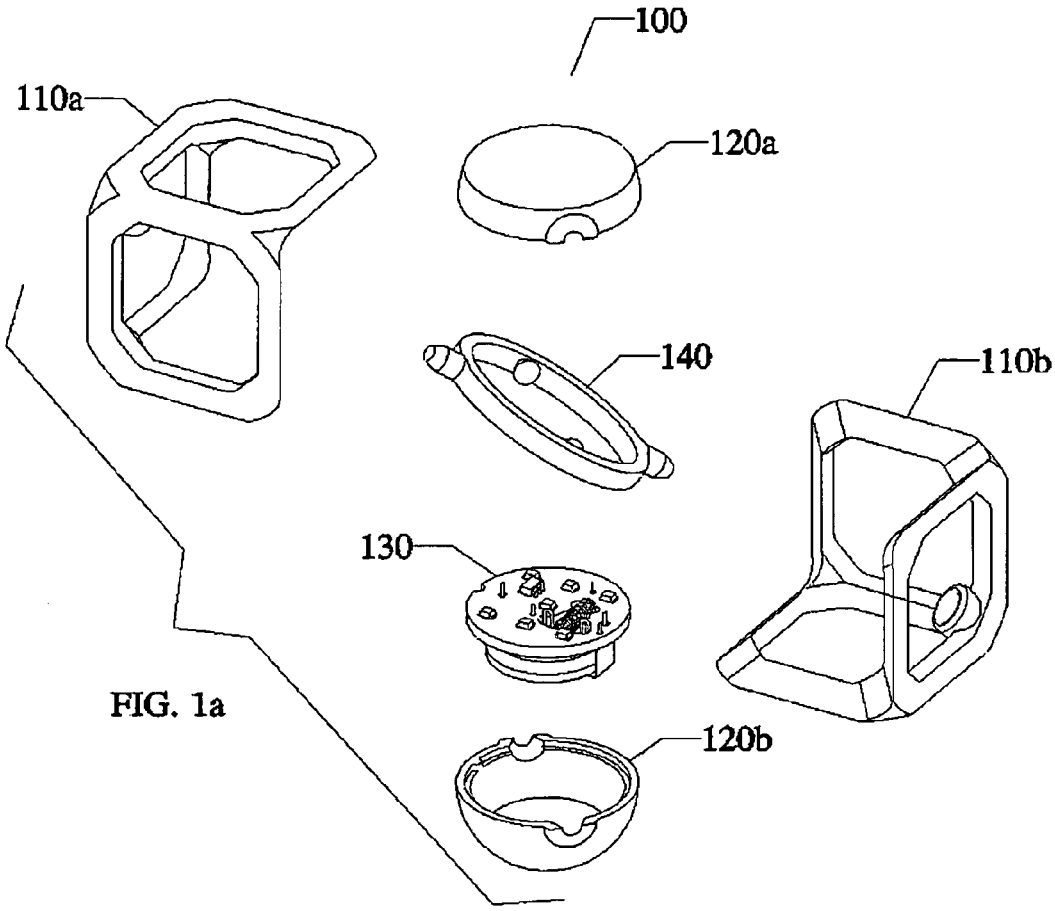
FIG. 1*a* shows an exploded view of one embodiment of the electronic lighted die according to the instant invention.

Dice are used in various amusement games and games of chance.

Dice are available in a variety of different shapes and sizes. The number of sides (facets or faces) on a die can range from as little as four (4) to dozens, and the size of a die can vary widely, from the very minute to the very large.

Conventional modern gaming dice are cubes having dots or other markings on their sides representing the numbers one (1) through six (6). The dots are placed on respective die faces so that the sum of the dots on opposite sides is always seven (7). Thus, for example, the numbers one (1) and six (6) appear on opposite sides of the cube, two (2) is opposite five (5), and three (3) is opposite four (4). Typically, the dice are rolled across a surface and the number displayed on the upwardly facing facet of each cube once they came to rest has some significance or importance.

The advent of electronic circuitry and illuminable numeric displays for use in conjunction, therewith, has created the opportunity to produce more advanced types of dice. Such "electronic dice" have been developed to increase the entertainment value and interest in using dice.

As used herein, the terms "die" and "dice" refer to any object capable of displaying a number. A die may have may have any number of sides or visible surfaces.

As used herein, the term "microprocessor" shall refer to any element or system which may compute a random value, and cause the random value to be displayed.

As used herein, the term "half-mirrored" shall refer to any element or system which partially reflects incident light on a surface while allowing light from the other side of the surface to shine through. This effect is also known as half-silvered mirror or two-way mirror.

As used herein, the term "face" means the viewable surface of a die or any object functioning as a die.

As used herein, the term "inner housing" means a structural component which encloses a display unit. A inner housing may have a shape other than spherical, as this term refers to a functional structural component for encasing a display unit, including but not limited to a faceted ball, octagonal, square, rectangular, tetrahedron, hexahedron, octahedron, dodecahedron, icosahedrons, polyhedron, square, rectangular, oval, pentagonal, hexagonal and combinations thereof.

As used herein the term "display unit" shall refer to any element includes a visible illuminated component, the configuration of which may be variable and determined by a microprocessor. A display may include lights, graphical interfaces, reflective components, LED lights or any other component capable of creating a viewable surface.

As used herein, the term "gimbal mount" shall refer to any element or system that permits the inner housing suspended within the gimbal mount to rotate freely. A gimbal is a pivoted support that allows the rotation of an object about an axis. A gimbal mount with two pivoting points allows the inner housing to rotate freely, thus keeping the display unit facing upwards regardless of the orientation of the shell.

As used herein the term "branding indicia" means trademarking, marking, printing, coloration or other indicia of brand.

DETAILED DESCRIPTION OF EMBODIMENTS OF THE INVENTION

For the purpose of promoting an understanding of the present invention, references are made in the text hereof to embodiments of an electronic lighted die, only some of which are depicted in the figures. It should nevertheless be understood that no limitations on the scope of the invention are thereby intended. One of ordinary skill in the art will readily appreciate that modifications such as the dimensions, size, and shape of the components, alternate but functionally similar materials from which the an electronic lighted die is made, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For examples one embodiment of the electronic lighted die is disclosed herein as being a cube, i.e., six (6) sided. The electronic lighted die might permissibly be somewhat non-cubical or have a number of sides other than six (6) and still be within the scope of the invention if its functionality is not materially altered.

Referring now to the drawings, FIG. 1*a* shows an exploded view of one embodiment of electronic lighted die 100 according to the instant invention. In the embodiment shown, electronic lighted die 100 is comprised of shell 110 (consisting of upper shell portion 110*a* and lower shell portion 110*b*), inner housing 120 (including upper inner housing portion 120*a* and lower inner housing portion 120*b*), display unit 130, and a gimbal mount 140. Display unit 130 is positioned within inner housing 120. Inner housing 120 is supported by gimbal mount 140. Gimbal mount 140 is supported within shell 110 allowing inner housing 120 to rotate freely within shell 110. In the embodiment shown, shell 110 is configured to form a six (6) sided chamber (in the shape of a die), into which the gimbal mount and inner housing are positioned. However, as discussed infra, shell 110 may be produced in alternative configurations, sizes and shapes which may be representational of other objects (e.g., a skull, a nugget, a diamond, a head, an automobile, a jack-o-lantern, a pumpkin, a snowman, Santa Claus, a cartoon character, a heart or any other shape or representation capable of being molded.)

In the embodiment' shown, shell 110 is comprised of upper shell portion 110*a* and lower shell portion 110*b*. Upper shell portion 110*a* and mates with lower shell portion 110*b* to form shell 110. In the embodiment shown, upper shell portion 110*a* and lower shell portion 110*b* are each three (3) sides of a cube such that when mated with its counterpart they form a six (6) sided cube. In other embodiments, upper shell portion 110*a* and lower shell portion 110*b* may have different mating configurations to conform to their molded shapes. It should be understood that in the embodiment shown, upper shell portion 110*a* and lower shell portion 110*b* each have three (3) faces, but in other embodiments, the resulting shell 110, as provided supra, can have fewer or more faces, dimensions, sides or mated components. Furthermore, shell 110 can be formed by any number of components to achieve the desired number of faces. For example, six (6) individual pieces can be pieced together, three (3) L-shaped pieces can be fitted together, or a five (5) sided piece can be mated with a single sided piece.

In the embodiment shown in FIG. 1*a*, upper shell portion 110*a* and lower shell portion 110*b* form a shell to support gimbal mount 140 when mated. In the embodiment shown, upper shell portion 110*a* and lower shell portion 110*b*, may be sealed by means commonly known and used in the art (i.e., ultrasonic weld or gluing operation) so as to form a shell to effectively support a gimbal mount.

Shell 110 may be made of any substantially or partially transparent material that is capable of being molded to form upper shell portion 110*a*, and lower shell portion 110*b* which may be connected or mated together. In the embodiment shown, upper shell portion 110*a*, and lower shell portion 110*b* are mated by an ultra-sonic weld forming shell 110. It should be understood that upper shell portion 110*a* and lower shell portion 120*b* can be made of any suitable material.

The embodiment shown in FIG. 1*a*, includes a single shell 110. Other embodiments may include multiple shells or layers of shells, forming various shells of inner layers and compartments, which may or may not function to support gimbal mount 140. In alternative embodiments, shell 110 may be formed of solid panels.

Also visible in FIG. 1*a* is inner housing 120. Inner housing 120 is formed of upper inner housing portion 120*a*, and lower inner housing portion 120*b* which mate to form inner housing 120. In the embodiment of electronic lighted die 100 shown in FIG. 1*a*, upper inner housing portion 120*a* and lower inner housing portion 120*b* are half-mirrored, allowing the display unit 130 to be visible (particularly when illuminated). In the embodiment shown, upper inner housing portion 120*a* and lower inner housing portion 120*b* are clear, scratch-resistant plastics, composites or polymers, compatible with mirror coatings, compatible with gluing operations, and accept printing thereon. However, other embodiments may not be scratch resistant, or may be alternate materials capable of being molded or machined to form upper inner housing portion 120*a* and lower inner housing portion 120*b*.

In the embodiment shown in FIG. 1*a*, the half-mirrored faces of upper inner housing portion 120*a* and lower inner housing portion 120*b* allow the lights contained within electronic lighted die 100 (described in greater detail infra) to be visible or apparent to a user, while minimizing the appearance of other components contained within inner housing 120.

It should be understood, however, that upper inner housing portion 120*a* and lower inner housing portion 120*b* need not be constructed of half-mirrored material, but rather may be transparent, partially transparent tinted, clouded, reflective, textured or treated with a material such as a varnish or film to produce a desired visual effect.

Additionally, in other embodiments, upper inner housing portion 120*a*, and lower inner housing portion 120*b* may be of a shape that is other than spherical.

Display unit 130 is positioned within inner housing 120, and inner housing 120 and a gimbal mount 140 are contained within shell 110 to allow inner housing 120 to rotate freely within shell 110. The gimbal mount 140 maintains inner housing 120 positioned substantially within the center of the chamber formed by upper shell portion 110*a* and lower shell portion 110*b*. The gimbal mount 140 supported within shell 110 allows inner housing 120 to rotate freely, positioning the center of gravity below the centerline of inner housing 120 to ensure that inner housing 120 is always positioned with the display facing upward.

Figure 1B:
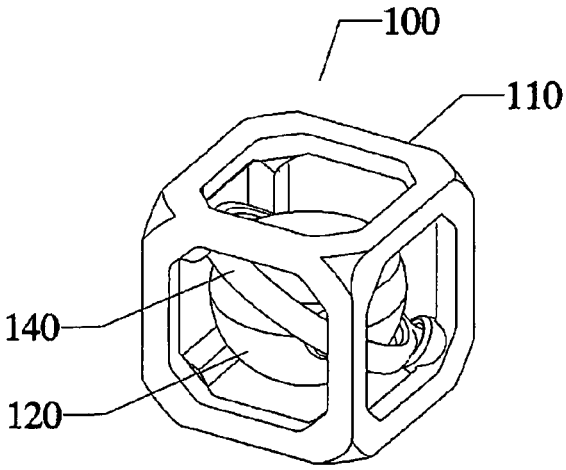
FIG. 1*b* shows a perspective view of one embodiment of the electronic lighted die.

FIG. 1*b* shows a perspective view of one embodiment of the electronic lighted die. Gimbal mount 140 is shown within shell 110 supporting inner housing 120 and maintaining inner housing 120 in an upright position.

Figure 1C:
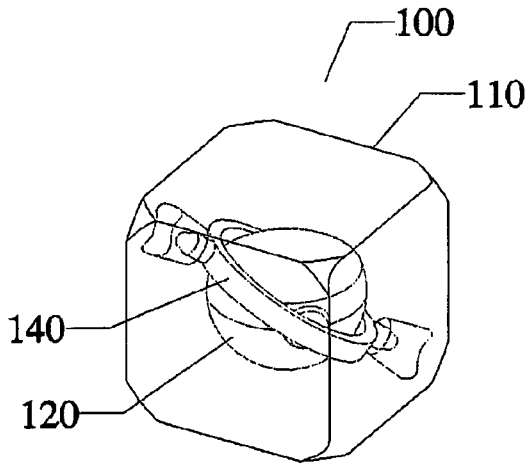
FIG. 1*c* shows a perspective view of one embodiment of the electronic lighted die with shell formed of solid panels.

FIG. 1*c* shows a perspective view of one embodiment of the electronic lighted die 100 with shell 110 formed of half-mirrored solid panels. Gimbal mount 140 is shown within shell 110 supporting inner housing 120 and maintaining inner housing 120 in an upright position.

Figure 2:
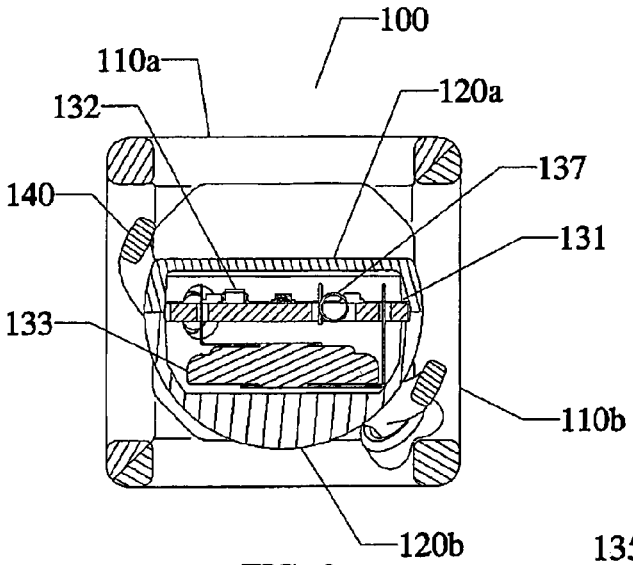
FIG. 2 shows a cross-sectional view of one embodiment of the electronic lighted die.

FIG. 2 shows a cross-sectional side view of the embodiment of lighted die 100. In this embodiment, shell 120 is supported by gimbal mount 140 (not shown) inside shell 110. Power source 133 being placed on the underside of PCB 131 causes the center of gravity of inner housing 120 to be below PCB 131. This arrangement causes the display side of PCB 131 containing light sources 135*a-g* to be displayed upward when inner housing 120 is allowed to move freely within gimbal mount 140 (not shown).

In the embodiment shown, sensor 137 activates microprocessor 132 when dropped. Thus, when electronic lighted die 100 is rolled or thrown, electronic lighted die 100 randomly generates a number between one (1) and six (6) (or another number if electronic lighted die 100 is programmed to simulate a die with an alternate number of faces) and show the randomly generated number using the light sources 135*a-g* positioned on PCB 131.

Figure 3:
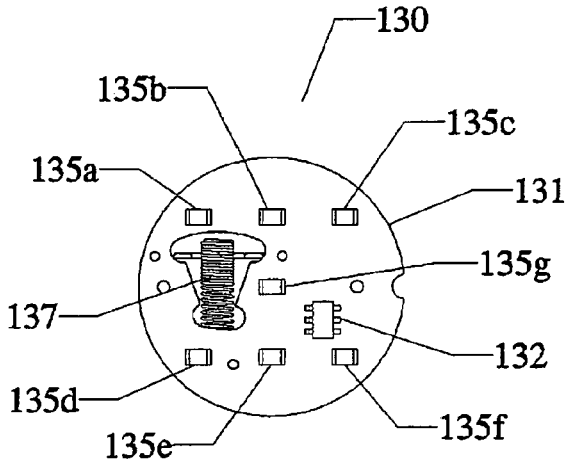
FIG. 3 shows a top view of the electronic circuit board assembly of one embodiment of the display unit.

FIG. 3 shows a top view of the electronic circuit board assembly of one embodiment of the display unit 130. In the embodiment shown, display unit 130 is comprised of printed circuit board (PCB) 131, microprocessor 132, power source 133 (as shown in FIG. 2), light sources 135*a-g*, and sensor 137. Microprocessor 132, power source 133, and sensor 137 may positioned on either the top surface or bottom surface of PCB 131. Light sources 135*a-g* are positioned on the top surface of PCB 131.

Figure 4:
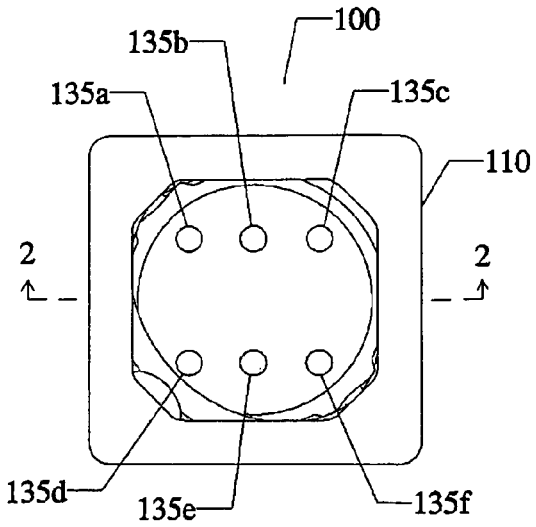
FIG. 4 shows a top view of one embodiment of the electronic lighted die with light sources illuminated.

FIG. 4 illustrates a top view of one embodiment of display unit 130. In the embodiment shown, visible on display unit 130 a value of six (6), as represented by six (6) illuminated LED lights (i.e., light sources as discussed infra.). Light sources 135*a-f* are clearly visible through the top of shell 110 forming the display of the value six (6). In this embodiment of lighted die 100, with inner housing 120 formed of half-mirrored material, unlit light source 135*g*, and other components of display unit 130 are not visible.

Figure 5:
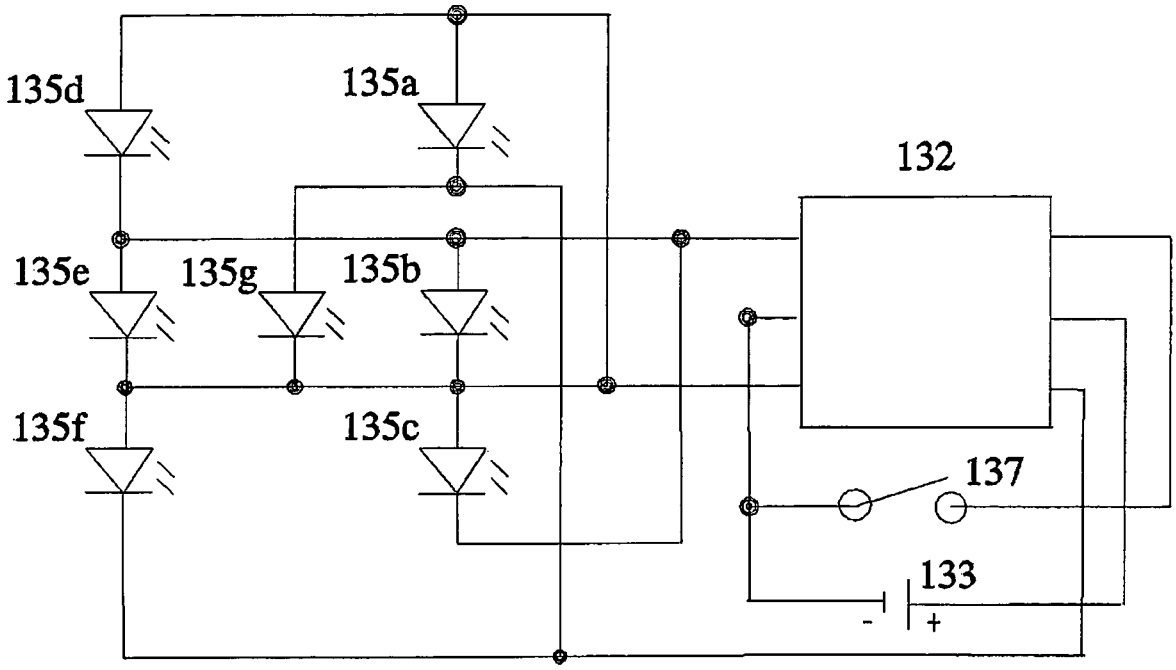
FIG. 5 shows a schematic of an exemplary embodiment of a circuit diagram for microprocessor circuit.

FIG. 5 shows a schematic of one exemplary embodiment of a circuit diagram for display unit 130. In the embodiment shown, microprocessor 132 is a six (6) pin, eight (8) bit flash microcontroller, part number PIC10F202 as manufactured by Microchip Technologies. However, microprocessor 132 can be any equivalent microprocessor 132 with similar capabilities. Microprocessor 132 is activated when electronic lighted die 100 dropped. When electronic lighted die 100 comes to a rest microprocessor 132 randomly generates a number between one (1) and six (6). Microprocessor 132 then displays the resulting number by illuminating between one (1) and six (6) of light sources 135*a-g*. In the embodiment shown, light sources 135*a-g* are each a red Light Emitting Diode (LED), but can be any other light source commonly used in the art.

Also visible in FIG. 5 is power source 133. In the embodiment, shown power source 133 is a 3V, 230 mAh high energy lithium battery in a button cell configuration. However, any alternate power source commonly known and used in the industry can be used. In the embodiment shown, power source 133 is mounted to the bottom of PCB 131. This creates a center of gravity of display unit 130 below PCB 131, ensuring that when rotated within the gimbal mount 140 (not shown) light sources 135*a-g* will face upward, allowing light sources 135*a-g* to be viewed.

In the exemplary embodiment shown, light sources 135*a-g* are Light Emitting Diodes (LED's). An LED has an anode (positive side) and a cathode (negative side). Current flows easily from the anode, to the cathode, but not in the reverse direction. An LED can only operate when a greater voltage is applied to its anode than its cathode. When the voltage of the anode is not greater than the cathode, the LED does not illuminate, and conducts substantially zero current. It is therefore possible to construct a circuit using LED's wherein LED's may be selectively illuminated by applying various combinations of positive voltage and ground to a matrix of LED's. An LED in the embodiment shown in FIG. 5 will only illuminate when a positive voltage is present on its anode and a lower voltage or ground is present on its cathode. To create the desired pattern of lit and unlit light sources 135*a-g*, microprocessor 132 alternately applies positive voltage and ground to each LED in the circuit shown in FIG. 5.

In the embodiment shown, after a predetermined time, microprocessor 132 ceases displaying the desired pattern of lit and unlit light sources 135*a-g*. Microprocessor 132 subsequently powers down until electronic lighted die 100 is moved and sensor 137 activates microprocessor 132 again.

While electronic lighted die 100 has been shown and described with respect to several embodiments and uses in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. An electronic lighted die comprised of:

at least one outer shell containing a gimbal mount; said gimbal mount supporting an inner housing; and a display unit contained within said inner housing, said display unit capable of displaying a random number within a defined range generated by a microprocessor.

2. The electronic lighted of claim 1, wherein said at least one outer shell is in the form of a six-sided cube.

3. The electronic lighted of claim 1, wherein said inner housing is half-mirrored.

4. The electronic lighted of claim 1, wherein said inner housing has a surface treatment selected from a group consisting of transparent, partially transparent, tinted, clouded, reflective, a film, holographic treatment, embossing and any combination thereof.

5. The electronic lighted of claim 1, wherein said outer shell is formed of solid panels.

6. The electronic lighted die of claim 5, wherein said outer shell has a surface treatment selected from a group consisting of transparent, partially transparent, tinted, clouded, reflective, a film and any combination thereof.

7. The electronic lighted die of claim 1, wherein said inner housing has a shape selected from a group consisting of a faceted ball, octagonal, square, rectangular, tetrahedron, hexahedron, octahedron, dodecahedron, icosahedrons, polyhedron, square, rectangular, oval, pentagonal, hexagonal and combinations thereof.

8. The electronic lighted die of claim 1, wherein said display unit has at least one light source for displaying said random number.

9. The electronic lighted die of claim 8 wherein said at least one light source are selected from the group consisting of light emitting diode, organic light emitting diode, electroluminescent display, incandescent lamp, plasma display, neon tube, cathode ray tube, and nixie tube.

10. An electronic lighted die comprised of:

at least one six-sided outer shell containing a gimbal mount; said gimbal mount supporting an inner housing; and a display unit contained within said inner housing, said display unit capable of displaying a random number within a defined range generated by a microprocessor.

11. The electronic lighted of claim 10, wherein said inner housing is half-mirrored.

12. The electronic lighted of claim 10, wherein said inner housing has a surface treatment selected from a group consisting of transparent, partially transparent, tinted, clouded, reflective, a film, holographic treatment, embossing and any combination thereof.

13. The electronic lighted of claim 10, wherein said outer shell is formed of solid panels.

14. The electronic lighted die of claim 13, wherein said outer shell has a surface selected from a group consisting of transparent, partially transparent, tinted, clouded, reflective, a film and any combination thereof.

15. The electronic lighted die of claim 10, wherein said inner housing has a shape selected from a group consisting of a faceted ball, octagonal, square, rectangular, tetrahedron, hexahedron, octahedron, dodecahedron, icosahedrons, polyhedron, square, rectangular, oval, pentagonal, hexagonal and combinations thereof.

16. The electronic lighted die of claim 10, wherein said display unit has at least one light source for displaying said random number.

17. The electronic lighted die of claim 16, wherein said at least one light source are selected from the group consisting of light emitting diode, organic light emitting diode, electroluminescent display, incandescent lamp, plasma display, neon tube, cathode ray tube, and nixie tube.

18. The electronic lighted die of claim 1, wherein said inner housing has a center of gravity that causes the random number to face an upward direction.

19. The electronic lighted die of claim 10 further comprising a battery coupled to an underside of said display unit opposite a display side of said display unit, wherein said battery coupled to said underside causes said display unit to rotate in said gimbal mount such that said display side comes to rest facing a substantially upward direction.

20. An electronic die comprised of:

an outer shell;

a gimbal mount coupled to said outer shell, wherein said gimbal mount is substantially within said outer shell and is configured to rotate within said outer shell;

an inner housing coupled to said gimbal mount such that said inner housing rotates freely within said gimbal mount; and a display unit attached to said inner housing, said display unit comprising a:

a microprocessor configured to generate a random number;

a light emitting component configured to display the random number; and a battery coupled to said display unit and configured to power said microprocessor; and wherein a combination of said inner housing and said display unit has a center of gravity that brings said inner housing to rest in a position where said light emitting component faces upward.

* * * * *